US011101536B2

(12) United States Patent
Hsiao et al.

(10) Patent No.: US 11,101,536 B2
(45) Date of Patent: Aug. 24, 2021

(54) DEVICE THAT TRANSITIONS BETWEEN A METAL SIGNAL LINE AND A WAVEGUIDE INCLUDING A DIELECTRIC LAYER WITH A PAIR OF OPENINGS FORMED THEREIN

(71) Applicant: Wistron NeWeb Corp., Hsinchu (TW)

(72) Inventors: An-Ting Hsiao, Hsinchu (TW); Shun-Chung Kuo, Hsinchu (TW); Cheng-Geng Jan, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 78 days.

(21) Appl. No.: 16/682,025

(22) Filed: Nov. 13, 2019

(65) Prior Publication Data

US 2020/0303802 A1 Sep. 24, 2020

(30) Foreign Application Priority Data

Mar. 21, 2019 (TW) ..... 108109715

(51) Int. Cl.

| | |
|---|---|
| ***H01P 5/107*** | (2006.01) |
| ***H01P 5/10*** | (2006.01) |
| ***H01P 3/16*** | (2006.01) |
| ***H01P 3/00*** | (2006.01) |

(52) U.S. Cl.

CPC ..... *H01P 5/107* (2013.01); *H01P 3/003* (2013.01); *H01P 3/16* (2013.01); *H01P 5/1022* (2013.01)

(58) Field of Classification Search

CPC ..... H01P 5/107
USPC ..... 333/26
See application file for complete search history.

(56) References Cited

U.S. PATENT DOCUMENTS

| | | | | |
|---|---|---|---|---|
| 5,982,250 | A * | 11/1999 | Hung et al. | H01L 23/49822 333/26 |
| 8,188,805 | B2 | 5/2012 | Nomura et al. | |
| 9,252,475 | B2 * | 2/2016 | Milyakh et al. | H01P 5/107 |
| 9,819,067 | B2 | 11/2017 | Yang et al. | |
| 2011/0057741 | A1 * | 3/2011 | Dayan et al. | H01P 5/107 333/26 |

(Continued)

FOREIGN PATENT DOCUMENTS

| | | | |
|---|---|---|---|
| CN | 202050037 | U | 11/2011 |
| CN | 105493343 | B | 1/2018 |
| CN | 105680133 | B | 8/2018 |

(Continued)

*Primary Examiner* — Benny T Lee
(74) *Attorney, Agent, or Firm* — McClure, Qualey & Rodack, LLP

(57) ABSTRACT

A transition device includes a first metal layer, a signaling metal line, an excitation metal piece, a first dielectric layer, a plurality of conductive via elements, a reflector, and a waveguide. The first metal layer has a notch. The notch extends to the interior of the first metal layer, forming a first slot region. The signaling metal line is disposed in the notch. The excitation metal piece is disposed in the first slot region and is coupled to the signaling metal line. The first dielectric layer has a pair of first openings. The first dielectric layer includes a bridging portion disposed between the first openings. The bridging portion is configured to carry the excitation metal piece. The conductive via elements penetrate the first dielectric layer and are coupled to the first metal layer. The conductive via elements at least partially surround the first slot region.

19 Claims, 10 Drawing Sheets

(56) References Cited

U.S. PATENT DOCUMENTS

| | | | | |
|---|---|---|---|---|
| 2015/0270616 | A1* | 9/2015 | Jafarlou et al. .... | H01Q 13/0283<br>343/786 |
| 2018/0358677 | A1* | 12/2018 | Artemenko et al. ..... | H01Q 1/50 |

FOREIGN PATENT DOCUMENTS

| | | | |
|---|---|---|---|
| CN | 108879056 | A | 11/2018 |
| EP | 2843758 | A1 | 3/2015 |
| TW | I456829 | B | 10/2014 |
| WO | 2012071877 | A1 | 6/2012 |

* cited by examiner

DEVICE THAT TRANSITIONS BETWEEN A METAL SIGNAL LINE AND A WAVEGUIDE INCLUDING A DIELECTRIC LAYER WITH A PAIR OF OPENINGS FORMED THEREIN

CROSS REFERENCE TO RELATED APPLICATIONS

This application claims priority of Taiwan Patent Application No. 108109715 filed on Mar. 21, 2019, the entirety of which is incorporated by reference herein.

BACKGROUND OF THE INVENTION

Field of the Invention

The disclosure generally relates to a transition device, and more particularly to a wideband transition device.

Description of the Related Art

Current vehicle radars mainly use FMCW (Frequency-Modulated Continuous-Wave) technology, which has an accuracy that is proportional to the signal bandwidth. However, a traditional transition device including a multilayer PCB (Printed Circuit Board) often has problems with insufficient operation bandwidth and large insertion loss, which degrade the performance of the whole system. Accordingly, there is a need to propose a novel design for overcoming the drawbacks of the prior art.

BRIEF SUMMARY OF THE INVENTION

In an exemplary embodiment, the disclosure is directed to a transition device which includes a first metal layer, a signaling metal line, an excitation metal piece, a first dielectric layer, a plurality of conductive via elements, a reflector, and a waveguide. The first metal layer has a notch. The notch extends to the interior of the first metal layer, forming a first slot region. The signaling metal line is disposed in the notch. The signaling metal line has a feeding point. The excitation metal piece is disposed in the first slot region. The excitation metal piece is coupled to the signaling metal line. The first dielectric layer has a pair of first openings. The first dielectric layer includes a bridging portion disposed between the first openings. The bridging portion is configured to carry the excitation metal piece. The conductive via elements penetrate the first dielectric layer. The conductive via elements are coupled to the first metal layer. The conductive via elements at least partially surround the first slot region. The reflector is disposed adjacent to the excitation metal piece. The first metal layer is positioned between the reflector and the first dielectric layer. The waveguide is configured to receive the radiation energy from the excitation metal piece and the reflector.

In some embodiments, the first metal layer includes a first grounding portion and a second grounding portion which are adjacent to the notch. A CPW (Coplanar Waveguide) is formed by the signaling metal line, the first grounding portion, and the second grounding portion.

In some embodiments, the signaling metal line has a variable-width structure so as to form an impedance tuner.

In some embodiments, the first openings of the first dielectric layer have a vertical projection on the first metal layer, and the vertical projection at least partially overlaps the first slot region of the first metal layer.

In some embodiments, the distance between two opposite sides of the first openings of the first dielectric layer is substantially from 0.8 times to 1.2 times the distance between two opposite sides of the first slot region of the first metal layer.

In some embodiments, the operational frequency band of the transition device is form 69.8 GHz to 83.7 GHz.

In some embodiments, the reflector has a hollow portion and a sidewall opening which are connected to each other. The hollow portion is substantially aligned with the first slot region of the first metal layer. The sidewall opening is substantially aligned with the notch of the first metal layer.

In some embodiments, the height of the hollow portion of the reflector is from 0.35 wavelength to 0.55 wavelength of the operational frequency band.

In some embodiments, the width of the sidewall opening of the reflector is shorter than 0.17 wavelength of the operational frequency band.

In some embodiments, the height of the sidewall opening of the reflector is from 0.1 wavelength to 0.18 wavelength of the operational frequency band.

In some embodiments, the length of each of the first openings is from 0.8 times to 1 times the length of the first slot region.

In some embodiments, the width of each of the first openings is from 0.23 times to 0.43 times the width of the first slot region.

In some embodiments, the transition device further includes a second metal layer and a second dielectric layer. The second metal layer has a second slot region. The second dielectric layer has a pair of second openings. The second metal layer is positioned between the first dielectric layer and the second dielectric layer. The conductive via elements further penetrate the second dielectric layer. The conductive via elements are further coupled to the second metal layer.

In some embodiments, the transition device further includes a third metal layer and a third dielectric layer. The third metal layer has a third slot region. The third dielectric layer has a pair of third openings. The third metal layer is positioned between the second dielectric layer and the third dielectric layer. The conductive via elements further penetrate the third dielectric layer. The conductive via elements are further coupled to the third metal layer.

In some embodiments, the transition device further includes a fourth metal layer and a fourth dielectric layer. The fourth metal layer has a fourth slot region. The fourth dielectric layer has a pair of fourth openings. The fourth metal layer is positioned between the third dielectric layer and the fourth dielectric layer. The conductive via elements further penetrate the fourth dielectric layer. The conductive via elements are further coupled to the fourth metal layer.

In some embodiments, the transition device further includes a fifth metal layer and a fifth dielectric layer. The fifth metal layer has a fifth slot region. The fifth dielectric layer has a pair of fifth openings. The fifth metal layer is positioned between the fourth dielectric layer and the fifth dielectric layer. The conductive via elements further penetrate the fifth dielectric layer. The conductive via elements are further coupled to the fifth metal layer.

In some embodiments, the transition device further includes a sixth metal layer and a sixth dielectric layer. The sixth metal layer has a sixth slot region. The sixth dielectric layer has a pair of sixth openings. The sixth metal layer is positioned between the fifth dielectric layer and the sixth dielectric layer. The conductive via elements further penetrate the sixth dielectric layer. The conductive via elements are further coupled to the sixth metal layer.

In some embodiments, the transition device further includes a seventh metal layer and a seventh dielectric layer. The seventh metal layer has a seventh slot region. The seventh dielectric layer has a pair of seventh openings. The seventh metal layer is positioned between the sixth dielectric layer and the seventh dielectric layer. The conductive via elements further penetrate the seventh dielectric layer. The conductive via elements are further coupled to the seventh metal layer.

In some embodiments, the transition device further includes an eighth metal layer. The eighth metal layer has an eighth slot region. The conductive via elements are further coupled to the eighth metal layer.

In some embodiments, the transition device further includes an auxiliary conductive via element. The auxiliary conductive via element penetrates the third dielectric layer, the fourth dielectric layer, the fifth dielectric layer, the sixth dielectric layer, and the seventh dielectric layer. The auxiliary conductive via element is configured to couple the third metal layer, the fourth metal layer, the fifth metal layer, the sixth metal layer, the seventh metal layer, and the eighth metal layer with each other in series.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows, where like features in the figures are denoted by the same reference numbers or labels.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . " The term "substantially" means the value is within an acceptable error range. Also, the term "couple" is intended to mean either an indirect or direct electrical connection. Accordingly, if one device is coupled to another device, that connection may be through a direct electrical connection, or through an indirect electrical connection via other devices and connections.

Figure 1:
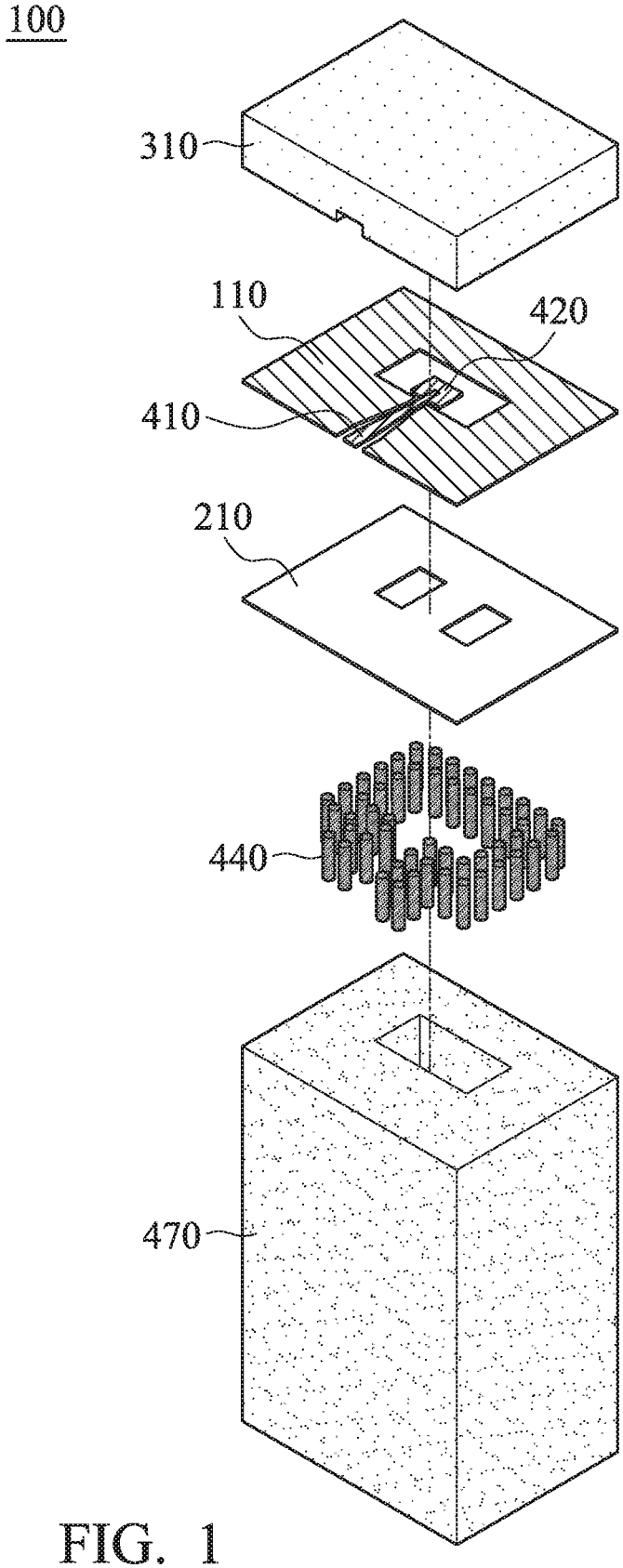
FIG. 1 is an exploded view of a transition device according to an embodiment of the invention.

FIG. 1 is an exploded view of a transition device 100 according to an embodiment of the invention. As shown in FIG. 1, the transition device 100 at least includes a first metal layer 110, a first dielectric layer 210, a reflector 310, a signaling metal line 410, an excitation metal piece 420, a plurality of conductive via elements 440, and a waveguide 470, whose detailed structures will be described in the following embodiments.

Figure 2:
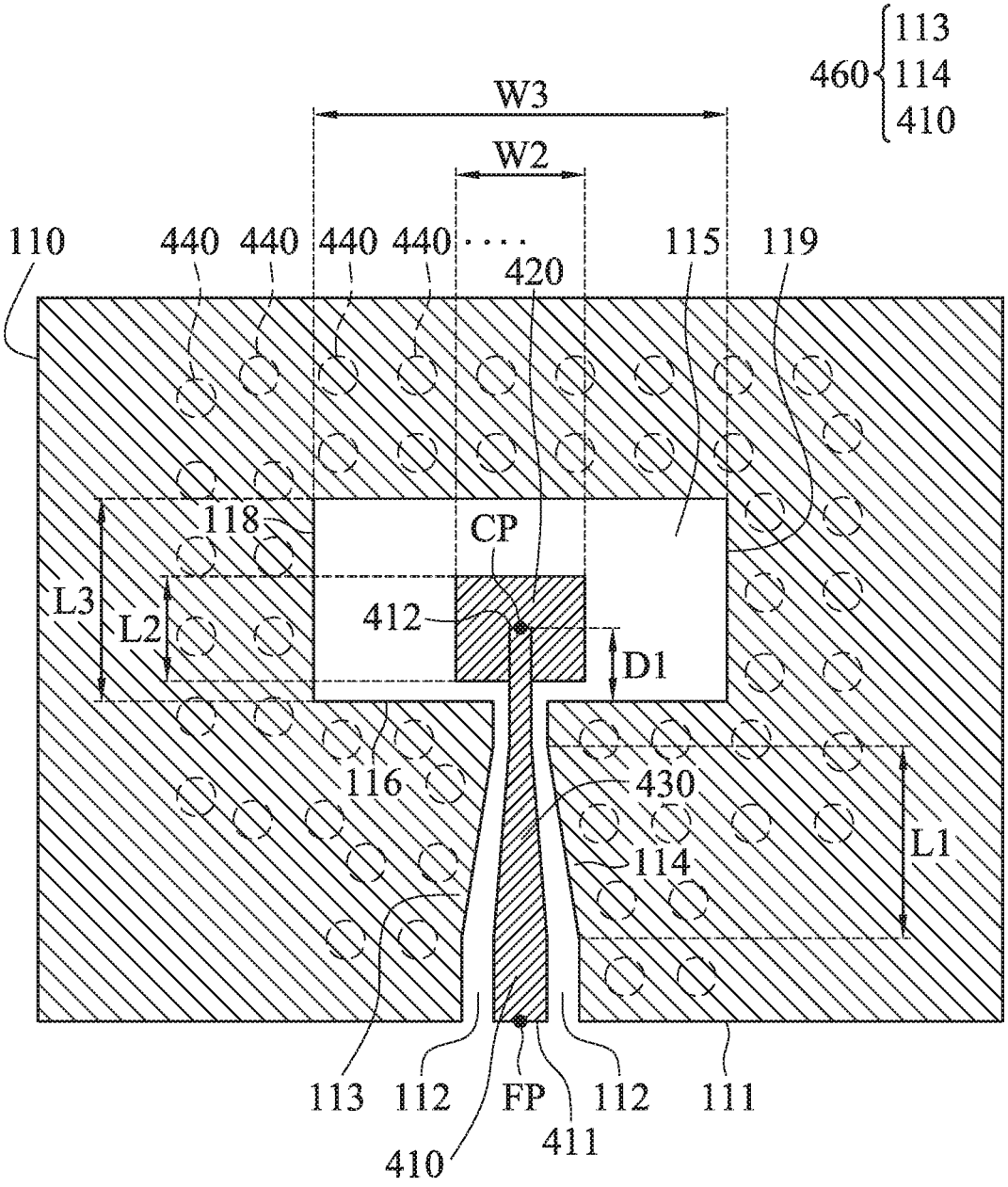
FIG. 2 is a top view of a first metal layer according to an embodiment of the invention.

FIG. 2 is a top view of the first metal layer 110 according to an embodiment of the invention. The first metal layer 110 is positioned between the reflector 310 and the first dielectric layer 210. As shown in FIG. 2, an edge 111 of the first metal layer 110 has a notch 112. The notch 112 extends to the interior of the first metal layer 110 so as to form a first slot region 115. For example, the notch 112 may substantially have a variable-width straight-line shape, and the first slot region 115 may substantially have a rectangular shape. The signaling metal line 410 is disposed in the notch 112 of the first metal layer 110. The signaling metal line 410 has a first end 411 and a second end 412. A feeding point FP is positioned at the first end 411 of the signaling metal line 410. The feeding point FP may be further coupled to a signal source (not shown). The excitation metal piece 420 is disposed in the first slot region 115 of the first metal layer 110. The central point CP of the excitation metal piece 420 is coupled to the second end 412 of the signaling metal line 410. For example, the excitation metal piece 420 may substantially have a rectangular shape or a square shape. The excitation metal piece 420 is mainly configured to convert the energy received by the feeding point FP into electromagnetic waves. In some embodiments, the signaling metal line 410 has a variable-width structure so as to form an impedance tuner 430 and fine-tune an input impedance value of the transition device 100. For example, the width of the first end 411 of the signaling metal line 410 may be greater than the width of the second end 412 of the signaling metal line 410. Specifically, the first metal layer 110 includes a first grounding portion 113 and a second grounding portion 114 which are adjacent to the notch 112. A CPW (Coplanar Waveguide) 460 is formed by the signaling metal line 410, the first grounding portion 113, and the second grounding portion 114. The excitation metal piece 420 and the CPW 460 may be positioned on the same plane. It should be noted that the term "adjacent" or "close" over the disclosure means that the distance (spacing) between two corresponding elements is smaller than a predetermined distance (e.g., 5 mm or the shorter), or means that the two corresponding elements directly touch each other (i.e., the aforementioned distance/spacing therebetween is reduced to 0). The aforementioned shapes of the notch 112, the first slot region 115, the signaling metal line 410, and the excitation metal piece 420 are adjustable to suit different requirements, and they may be changed to any geometric shape. In alternative embodiments, the impedance tuner 430 is omitted. Adjustments are made such that the signaling metal line 410 has an equal-width structure, and the notch 112 of the first metal layer 110 has an equal-width straight-line shape.

Figure 3:
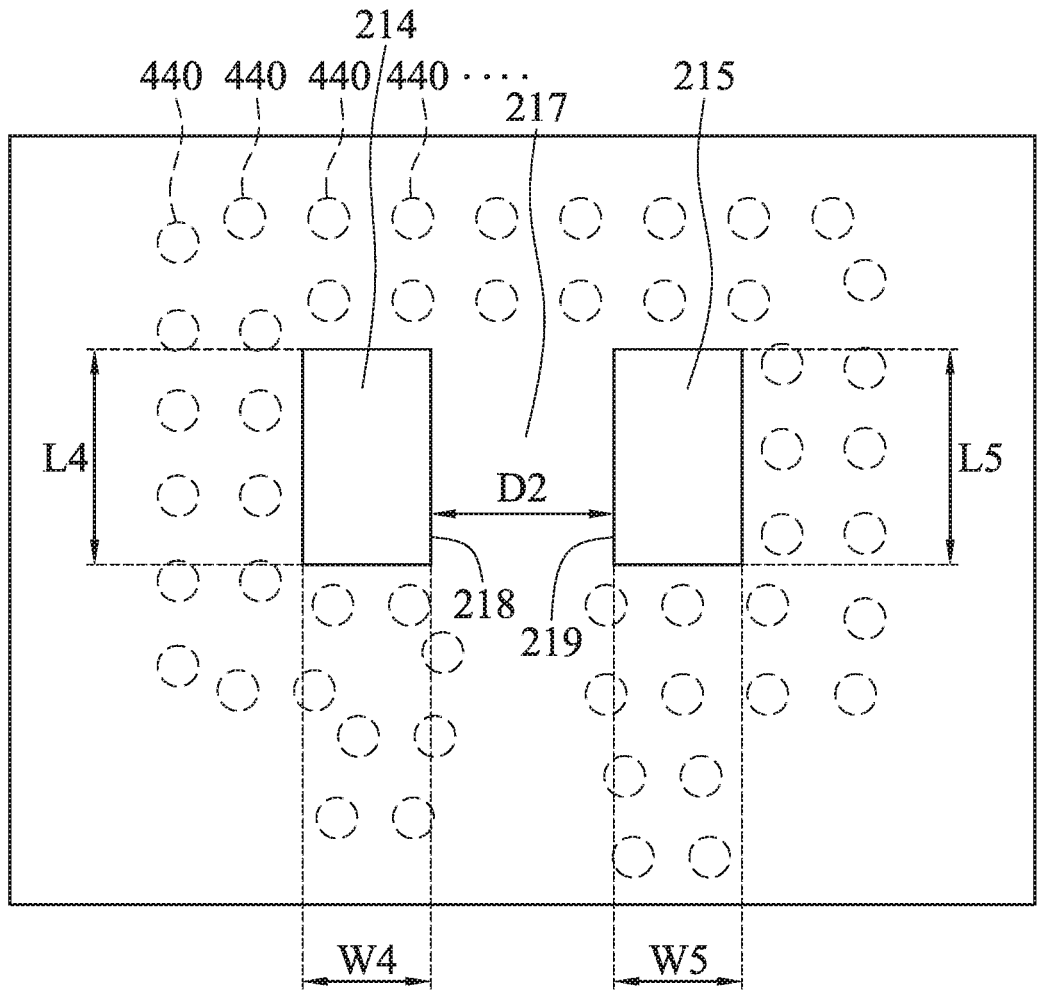
FIG. 3 is a top view of a first dielectric layer according to an embodiment of the invention.

FIG. 3 is a top view of the first dielectric layer 210 according to an embodiment of the invention. Please refer to FIG. 2 and FIG. 3 together. As shown in FIG. 3, the first dielectric layer 210 has a pair of first openings 214 and 215 which are completely separate from each other. For example, each of the first openings 214 and 215 may substantially have a rectangular shape or a square shape. The first dielectric layer 210 includes a bridging portion 217 disposed between the first openings 214 and 215. The bridging portion 217 is configured to carry the excitation metal piece 420, so as to enhance the structural stability of the transition device 100. Specifically, the first openings 214 and 215 have a vertical projection on the first metal layer 110, and the vertical projection at least partially overlaps the first slot region 115 of the first metal layer 110. For example, the vertical projection of the first openings 214 and 215 may be entirely inside the first slot region 115, but it is not limited thereto. The conductive via elements 440 penetrate the first dielectric layer 210, and the conductive via elements 440 are coupled to the first metal layer 110. The conductive via elements 440 at least partially surround the first slot region 115 of the first metal layer 110, so as to prevent the electromagnetic waves of the excitation metal piece 420 from leaking outwardly. In alternative embodiments, the shape of first opening 214 and of first opening 215 may be adjusted to any geometric shape, to suit different requirements.

Figure 4:
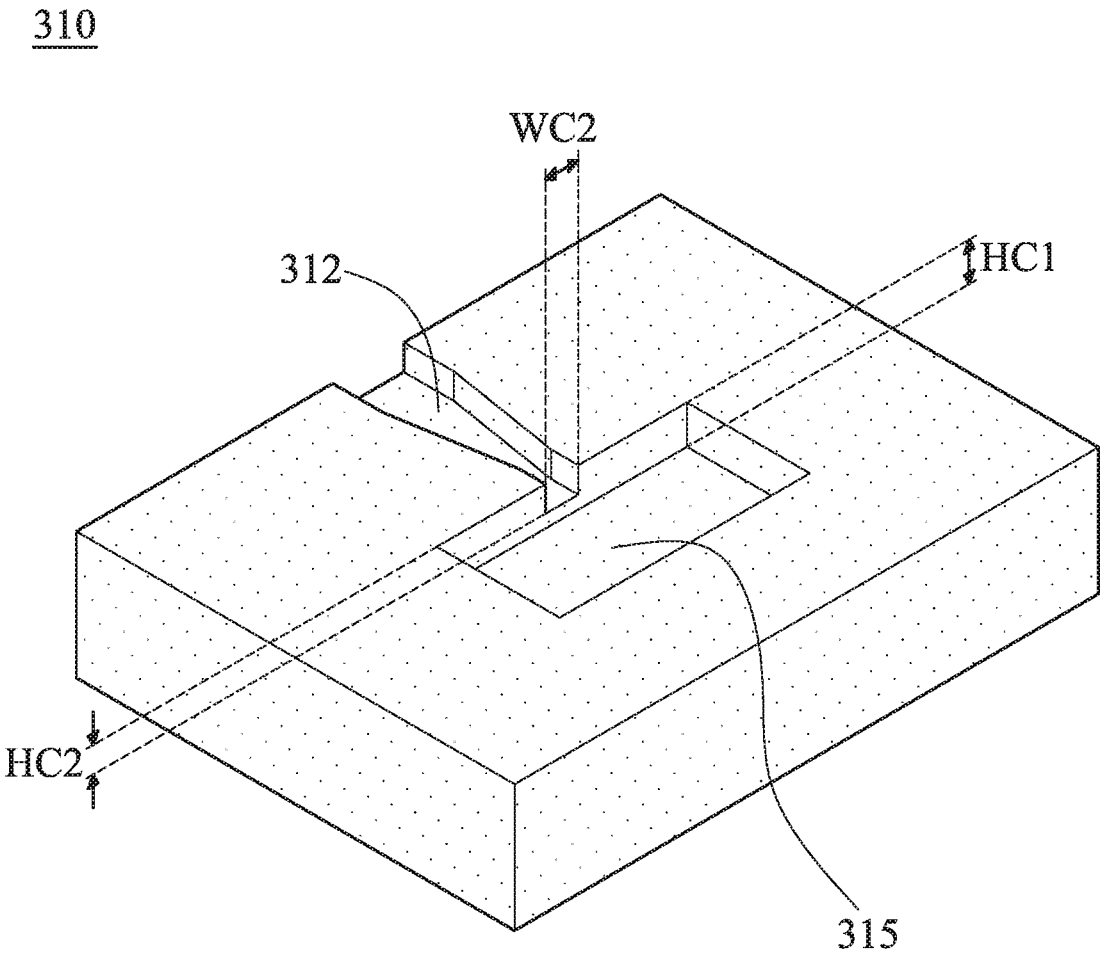
FIG. 4 is a perspective view of a reflector according to an embodiment of the invention.

FIG. 4 is a perspective view of the reflector 310 according to an embodiment of the invention. As shown in FIG. 4, the reflector 310 substantially has a cover structure. The reflector 310 is disposed adjacent to the excitation metal piece 420, so as to reflect the electromagnetic waves from the excitation metal piece 420. Specifically, the reflector 310 has a hollow portion 315 and a sidewall opening 312 which are connected to each other. The hollow portion 315 of the reflector 310 may be substantially aligned with the first slot region 115 of the first metal layer 110. The sidewall opening 312 of the reflector 310 may be substantially aligned with the notch 112 of the first metal layer 110. However, the invention is not limited thereto. In alternative embodiments, adjustments are made such that the reflector 310 is a metal plane with a different shape, such as another metal layer of a multilayer PCB (Printed Circuit Board).

In some embodiments, the operation principles of the transition device 100 are described as follows. The excitation metal piece 420 can convert the energy entering the feeding point FP and the signaling metal line 410 into electromagnetic waves (i.e., the radiation energy). The reflector 310 can fine-tune and centralize the transmission directions of the electromagnetic waves. The waveguide 470 can receive the radiation energy from the excitation metal piece 420 and the reflector 310. That is, the signaling metal line 410 is considered as an input port of the transition device 100, and the waveguide 470 is considered as an output port of the transition device 100. According to practical measurements, the operation bandwidth of the transition device 100 is increased after the first openings 214 and 215 are added to the first dielectric layer 210. Furthermore, the incorporation of the first openings 214 and 215 can prevent the first dielectric layer 210 from absorbing a portion of the electromagnetic waves. Such a design can reduce the whole transmission loss of the transition device 100.

In some embodiments, the transition device 100 covers an operational frequency band from 69.8 GHz to 83.7 GHz, and therefore the transition device 100 supports the wideband signal transition operations of vehicle radars. It should be noted that the range of the operation frequency band of the transition device 100 is adjustable to suit different requirements, and it is not limited thereto.

In some embodiments, the element sizes of the transition device 100 are described as follows. The length L1 (FIG. 2) of the impedance tuner 430 may be from 0.45 wavelength to 0.56 wavelength (0.45λ~0.56λ) of the operation frequency band of the transition device 100. The length L2 (FIG. 2) of the excitation metal piece 420 may be from 0.25 wavelength to 0.33 wavelength (0.25λ~0.33λ) of the operation frequency band of the transition device 100. The width W2 (FIG. 2) of the excitation metal piece 420 may be from 0.31 wavelength to 0.39 wavelength (0.31λ~0.39λ) of the operation frequency band of the transition device 100. The length L4 (FIG. 3) of the first opening 214 may be from 0.8 times to 1 times the length L3 (FIG. 2) of the first slot region 115 (0.8*L3~1*L3). The width W4 (FIG. 3) of the first opening 214 may be from 0.23 times to 0.43 times the width W3 (FIG. 2) of the first slot region 115 (0.23*W3~0.43*W3). The length L5 (FIG. 3) of the first opening 215 may be from 0.8 times to 1 times the length L3 of the first slot region 115 (0.8*L3~1*L3). The width W5 (FIG. 3) of the first opening 215 may be from 0.23 times to 0.43 times the width W3 of the first slot region 115 (0.23*W3~0.43*W3). The distance D1 (FIG. 2) between the central point CP of the excitation metal piece 420 and an edge 116 of the first slot region 115 may be from 0.25 times to 0.45 times the length L3 of the first slot region 115 (0.25*L3~0.45*L3). The distance D2 (FIG. 3) between two opposite sides 218 and 219 (FIG. 3) of the first openings 214 and 215 of the first dielectric layer 210 may be substantially from 0.8 times to 1.2 times the distance between two opposite sides 118 and 119 (FIG. 2) of the first slot region 115 of the first metal layer 110 (e.g., the distance between the two opposite sides 118 and 119 of the first slot region 115 may be the same as the width W3 of the first slot region 115) (0.8*W3~1.2*W3). The height HC1 (FIG. 4) of the hollow portion 315 of the reflector 310 may be from 0.35 wavelength to 0.55 wavelength (0.35λ~0.55λ) of the operation frequency band of the transition device 100. The width WC2 (FIG. 4) of the sidewall opening 312 of the reflector 310 may be shorter than 0.17 wavelength (<0.17λ) of the operation frequency band of the transition device 100. The height HC2 (FIG. 4) of the sidewall opening 312 of the reflector 310 may be from 0.1 wavelength to 0.18 wavelength (0.1λ~0.18λ) of the operation frequency band of the transition device 100. The above ranges of element sizes are calculated and obtained according to many experiment results, and they help to optimize the operation bandwidth and impedance matching of the transition device 100.

Figure 5:
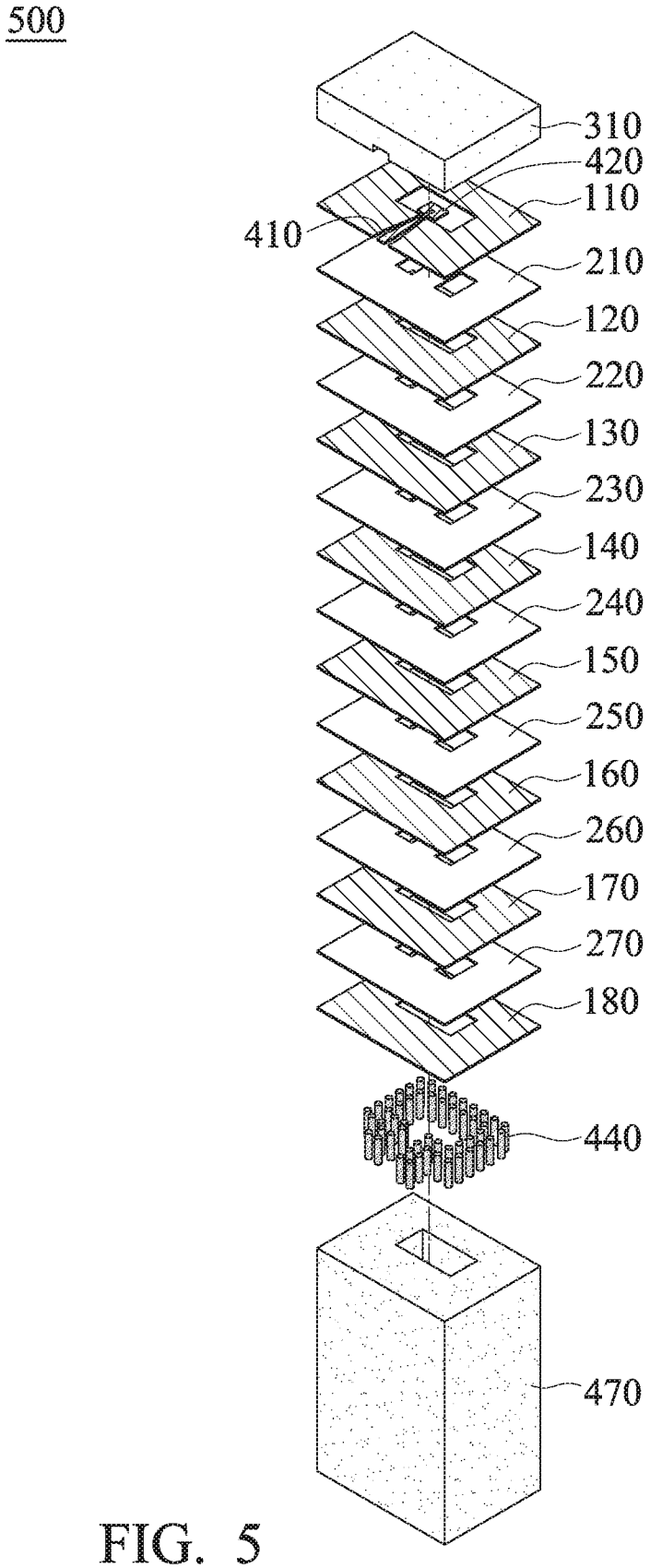
FIG. 5 is an exploded view of a transition device according to an embodiment of the invention.
Figure 6:
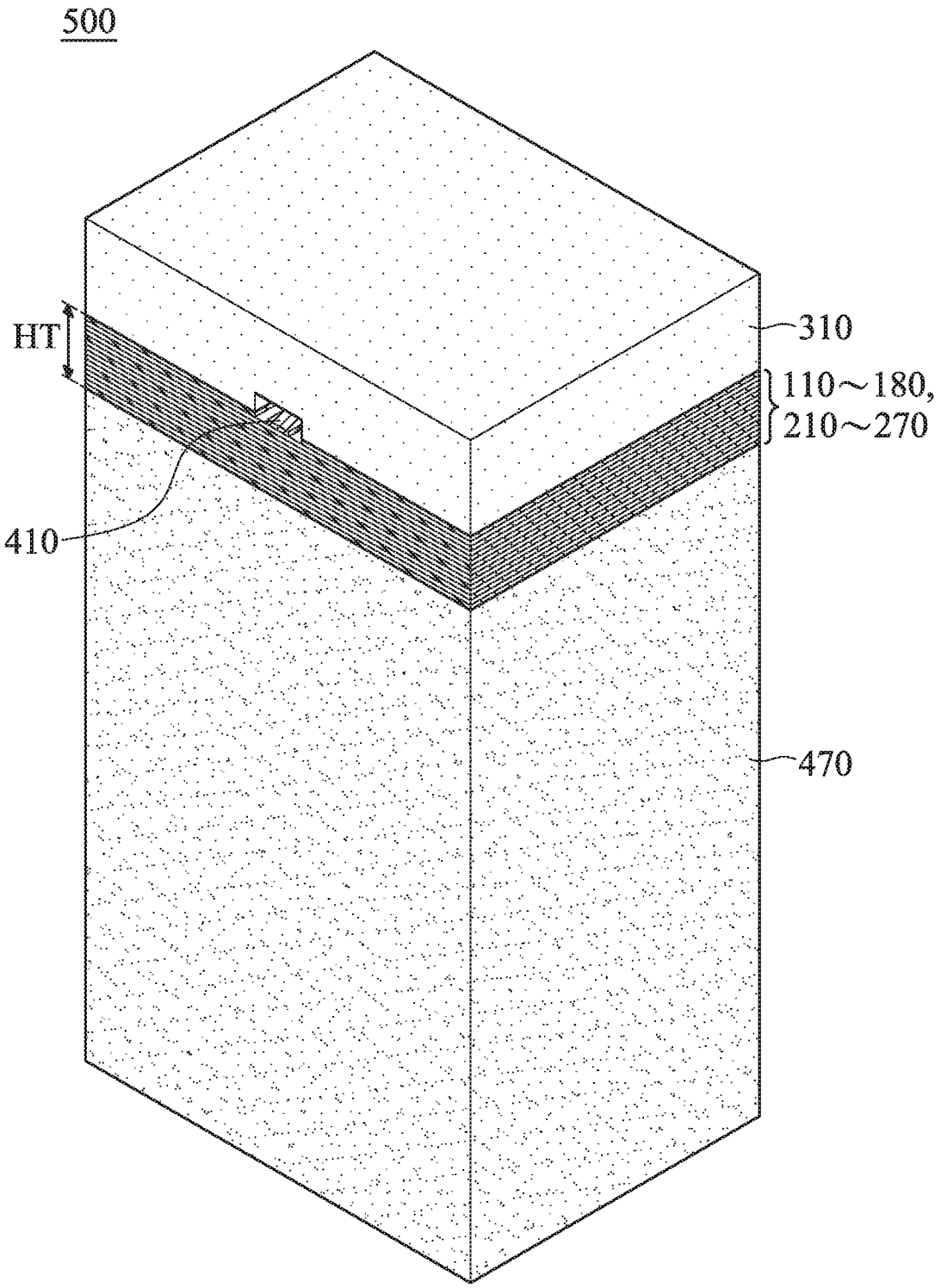
FIG. 6 is a combined view of a transition device according to an embodiment of the invention.

FIG. 5 is an exploded view of a transition device 500 according to an embodiment of the invention. FIG. 6 is a combined view of the transition device 500 according to an embodiment of the invention. FIG. 5 and FIG. 6 are similar to FIG. 1. In the embodiment of FIG. 5 and FIG. 6, the transition device 500 further includes one or more of the following elements: a second metal layer 120, a second dielectric layer 220, a third metal layer 130, a third dielectric layer 230, a fourth metal layer 140, a fourth dielectric layer 240, a fifth metal layer 150, a fifth dielectric layer 250, a sixth metal layer 160, a sixth dielectric layer 260, a seventh metal layer 170, a seventh dielectric layer 270, and an eighth metal layer 180, whose detailed structures will be described in the following embodiments.

Figure 7:
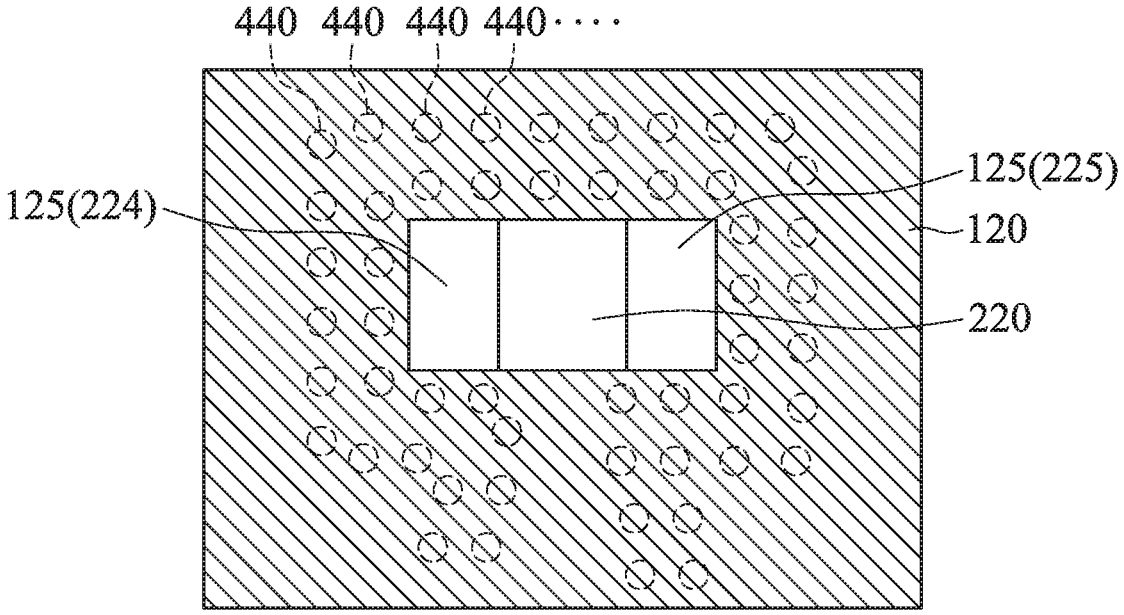
FIG. 7 is a top view of a second metal layer and a second dielectric layer according to an embodiment of the invention.

FIG. 7 is a top view of the second metal layer 120 and the second dielectric layer 220 according to an embodiment of the invention. The second metal layer 120 is disposed between the first dielectric layer 210 and the second dielectric layer 220. The second metal layer 120 is similar to the first metal layer 110 (FIG. 2). The difference between the first metal layer 110 and the second metal layer 120 is that the second metal layer 120 only has a second slot region 125; however, the second metal layer 120 does not have any notch, and does not include the signaling metal line 410 and the excitation metal piece 420 therein. For example, the second slot region 125 of the second metal layer 120 may substantially have a closed rectangular shape. The second slot region 125 of the second metal layer 120 may be substantially aligned with the first slot region 115 of the first metal layer 110, such that the electromagnetic waves of the excitation metal piece 420 can be transmitted through the second slot region 125 and the first slot region 115. The second dielectric layer 220 may be similar or identical to the first dielectric layer 210. The second dielectric layer 220 has a pair of second openings 224 and 225. For example, each of the second openings 224 and 225 may substantially have a rectangular shape or a square shape. The second openings 224 and 225 of the second dielectric layer 220 may be substantially aligned with the first openings 214 and 215 of the first dielectric layer 210, respectively, so as to reduce the transmission loss of the electromagnetic waves of the excitation metal piece 420. In addition, the conductive via elements 440 further penetrate the second dielectric layer 220, and the conductive via elements 440 are further coupled to the second metal layer 120. The conductive via elements 440 at least partially surround the second slot region 125 of the second metal layer 120, so as to prevent the electromagnetic waves of the excitation metal piece 420 from leaking outwardly.

Figure 8:
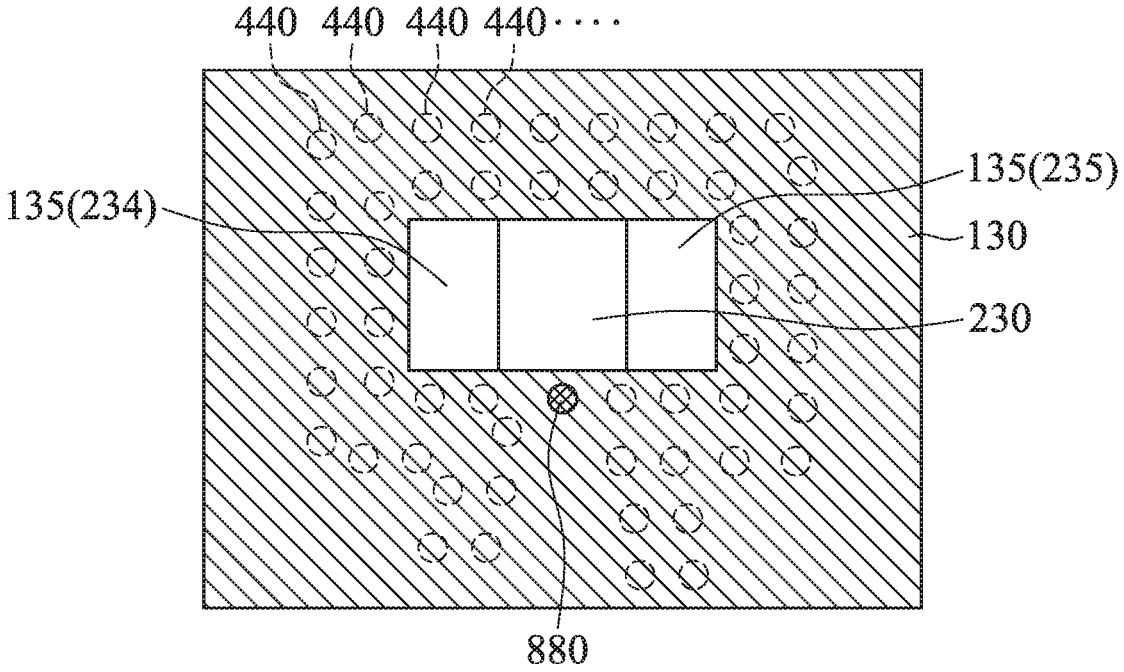
FIG. 8 is a top view of a third metal layer and a third dielectric layer according to an embodiment of the invention.

FIG. 8 is a top view of the third metal layer 130 and the third dielectric layer 230 according to an embodiment of the invention. The third metal layer 130 is disposed between the second dielectric layer 220 and the third dielectric layer 230. The third metal layer 130 is similar or identical to the second metal layer 120. The third metal layer 130 only has a third slot region 135. The third slot region 135 of the third metal layer 130 is substantially aligned with the second slot region 125 of the second metal layer 120. The third dielectric layer 230 is similar or identical to the second dielectric layer 220. The third dielectric layer 230 has a pair of third openings 234 and 235. The third openings 234 and 235 of the third dielectric layer 230 are substantially aligned with the second openings 224 and 225 of the second dielectric layer 220, respectively. In addition, the conductive via elements 440 further penetrate the third dielectric layer 230, and the conductive via elements 440 are further coupled to the third metal layer 130. The conductive via elements 440 at least partially surround the third slot region 135 of the third metal layer 130.

Figure 9:
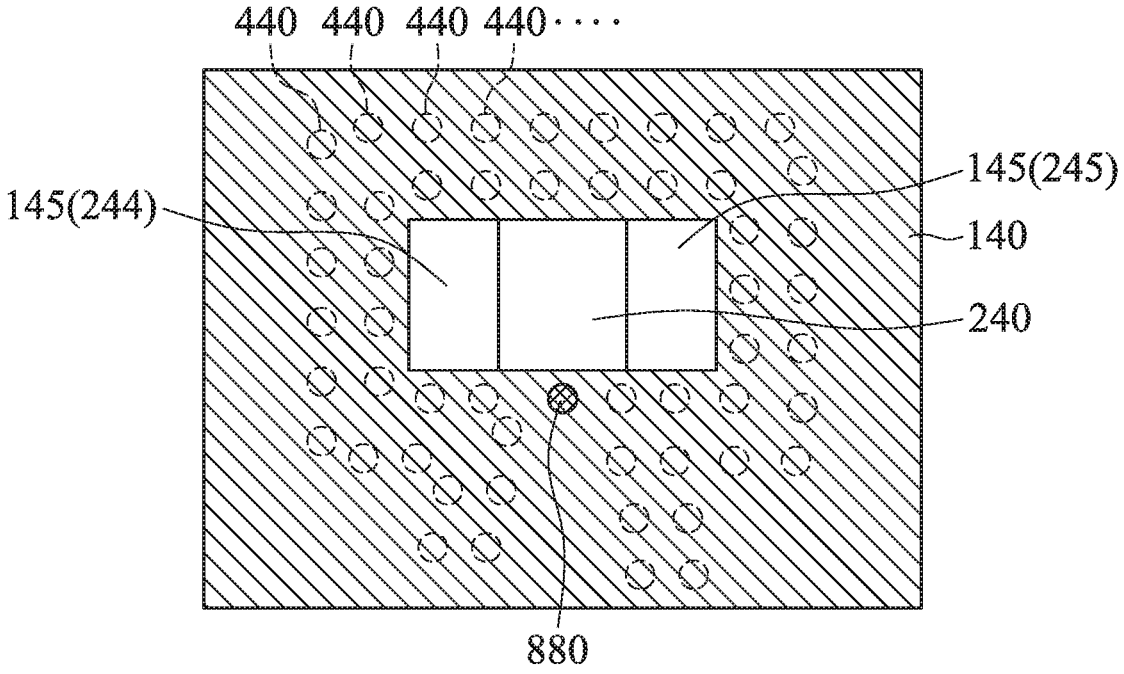
FIG. 9 is a top view of a fourth metal layer and a fourth dielectric layer according to an embodiment of the invention.

FIG. 9 is a top view of the fourth metal layer 140 and the fourth dielectric layer 240 according to an embodiment of the invention. The fourth metal layer 140 is disposed between the third dielectric layer 230 and the fourth dielectric layer 240. The fourth metal layer 140 is similar or identical to the third metal layer 130. The fourth metal layer 140 only has a fourth slot region 145. The fourth slot region 145 of the fourth metal layer 140 is substantially aligned with the third slot region 135 of the third metal layer 130. The fourth dielectric layer 240 is similar or identical to the third dielectric layer 230. The fourth dielectric layer 240 has a pair of fourth openings 244 and 245. The fourth openings 244 and 245 of the fourth dielectric layer 240 are substantially aligned with the third openings 234 and 235 of the third dielectric layer 230, respectively. In addition, the conductive via elements 440 further penetrate the fourth dielectric layer 240, and the conductive via elements 440 are further coupled to the fourth metal layer 140. The conductive via elements 440 at least partially surround the fourth slot region 145 of the fourth metal layer 140.

Figure 10:
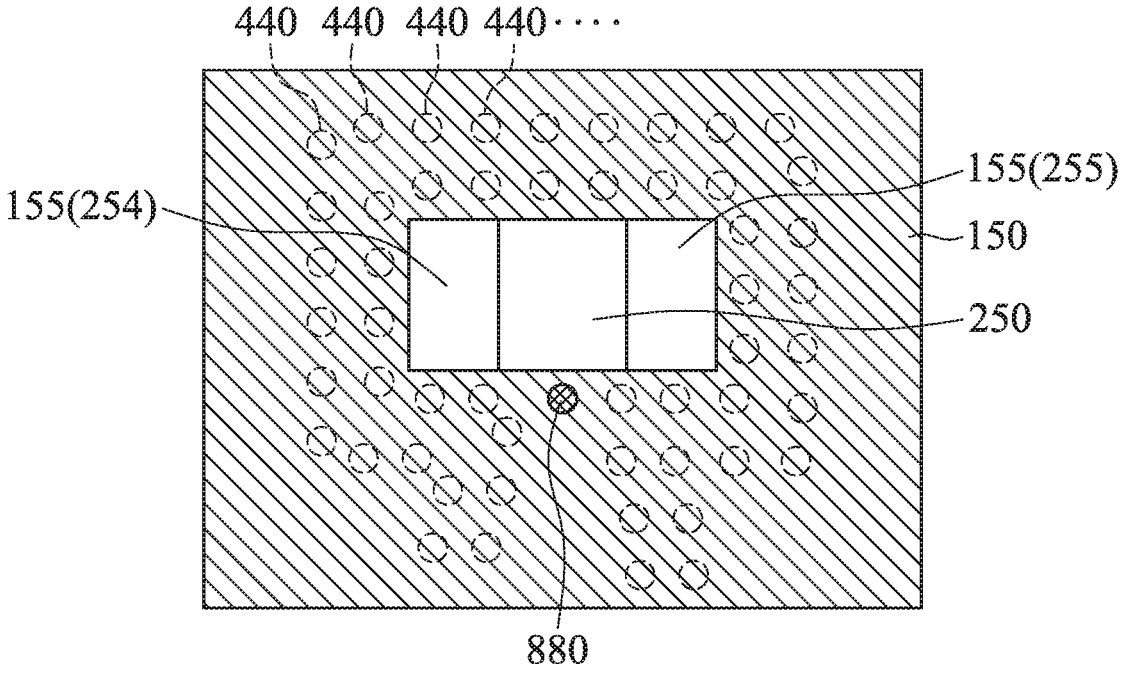
FIG. 10 is a top view of a fifth metal layer and a fifth dielectric layer according to an embodiment of the invention.

FIG. 10 is a top view of the fifth metal layer 150 and the fifth dielectric layer 250 according to an embodiment of the invention. The fifth metal layer 150 is disposed between the fourth dielectric layer 240 and the fifth dielectric layer 250. The fifth metal layer 150 is similar or identical to the fourth metal layer 140. The fifth metal layer 150 only has a fifth slot region 155. The fifth slot region 155 of the fifth metal layer 150 is substantially aligned with the fourth slot region 145 of the fourth metal layer 140. The fifth dielectric layer 250 is similar or identical to the fourth dielectric layer 240. The fifth dielectric layer 250 has a pair of fifth openings 254 and 255. The fifth openings 254 and 255 of the fifth dielectric layer 250 are substantially aligned with the fourth openings 244 and 245 of the fourth dielectric layer 240, respectively. In addition, the conductive via elements 440 further penetrate the fifth dielectric layer 250, and the conductive via elements 440 are further coupled to the fifth metal layer 150. The conductive via elements 440 at least partially surround the fifth slot region 155 of the fifth metal layer 150.

Figure 11:
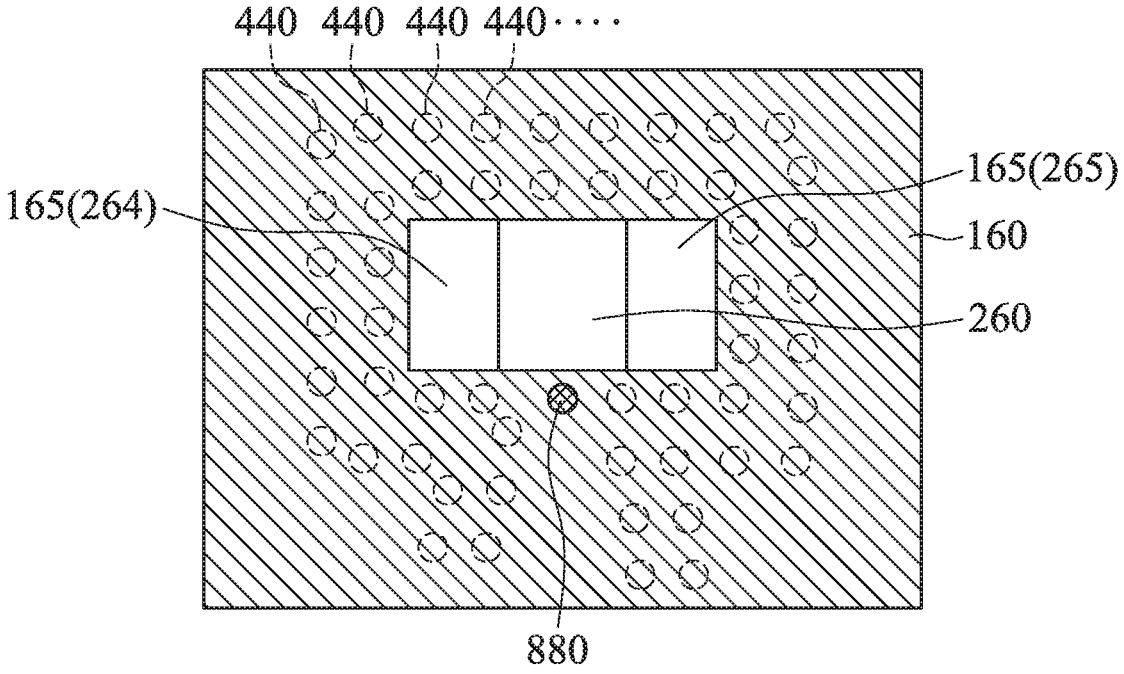
FIG. 11 is a top view of a sixth metal layer and a sixth dielectric layer according to an embodiment of the invention.

FIG. 11 is a top view of the sixth metal layer 160 and the sixth dielectric layer 260 according to an embodiment of the invention. The sixth metal layer 160 is disposed between the fifth dielectric layer 250 and the sixth dielectric layer 260. The sixth metal layer 160 is similar or identical to the fifth metal layer 150. The sixth metal layer 160 only has a sixth slot region 165. The sixth slot region 165 of the sixth metal layer 160 is substantially aligned with the fifth slot region 155 of the fifth metal layer 150. The sixth dielectric layer 260 is similar or identical to the fifth dielectric layer 250. The sixth dielectric layer 260 has a pair of sixth openings 264 and 265. The sixth openings 264 and 265 of the sixth dielectric layer 260 are substantially aligned with the fifth openings 254 and 255 of the fifth dielectric layer 250, respectively. In addition, the conductive via elements 440 further penetrate the sixth dielectric layer 260, and the conductive via elements 440 are further coupled to the sixth metal layer 160. The conductive via elements 440 at least partially surround the sixth slot region 165 of the sixth metal layer 160.

Figure 12:
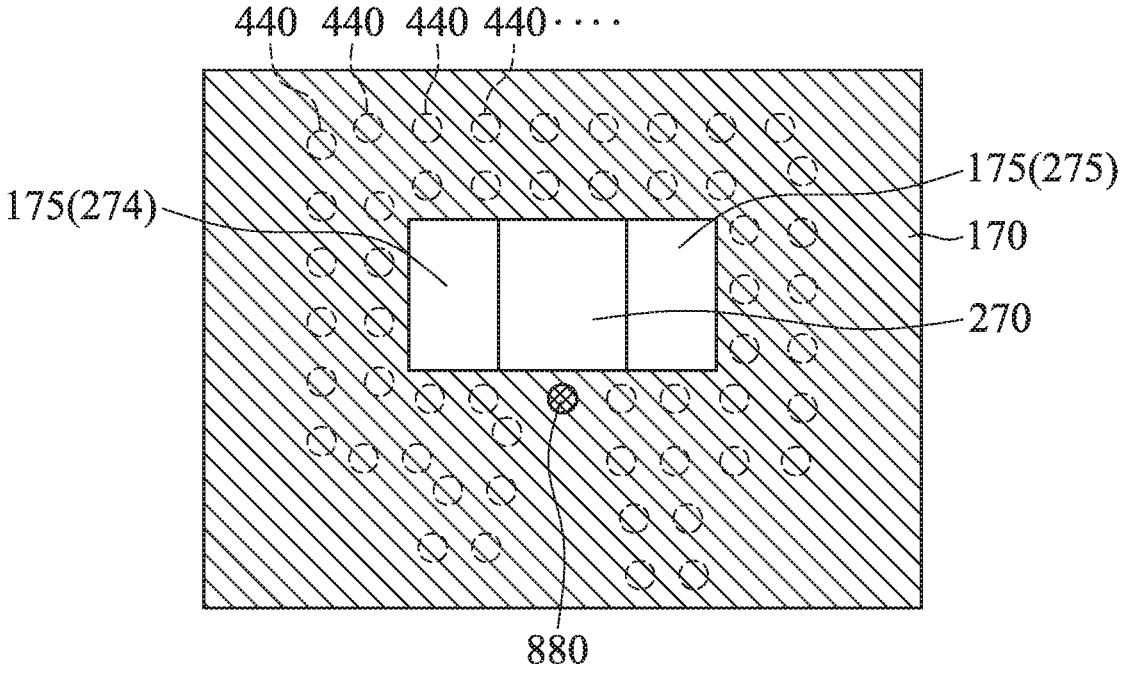
FIG. 12 is a top view of a seventh metal layer and a seventh dielectric layer according to an embodiment of the invention.

FIG. 12 is a top view of the seventh metal layer 170 and the seventh dielectric layer 270 according to an embodiment of the invention. The seventh metal layer 170 is disposed between the sixth dielectric layer 260 and the seventh dielectric layer 270. The seventh metal layer 170 is similar or identical to the sixth metal layer 160. The seventh metal layer 170 only has a seventh slot region 175. The seventh slot region 175 of the seventh metal layer 170 is substantially aligned with the sixth slot region 165 of the sixth metal layer 160. The seventh dielectric layer 270 is similar or identical to the sixth dielectric layer 260. The seventh dielectric layer 270 has a pair of seventh openings 274 and 275. The seventh openings 274 and 275 of the seventh dielectric layer 270 are substantially aligned with the sixth openings 264 and 265 of the sixth dielectric layer 260, respectively. In addition, the conductive via elements 440 further penetrate the seventh dielectric layer 270, and the conductive via elements 440 are further coupled to the seventh metal layer 170. The conductive via elements 440 at least partially surround the seventh slot region 175 of the seventh metal layer 170.

Figure 13:
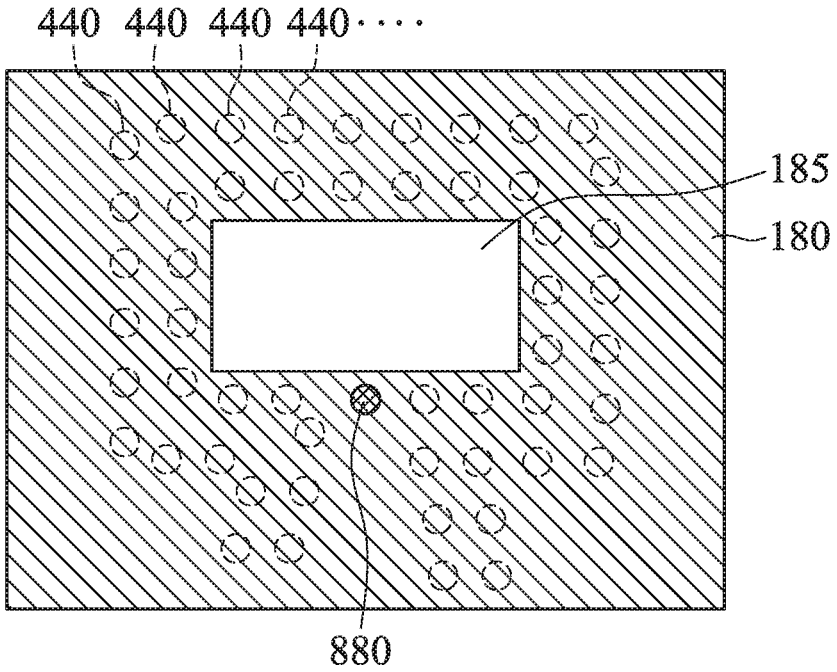
FIG. 13 is a top view of an eighth metal layer according to an embodiment of the invention.

FIG. 13 is a top view of the eighth metal layer 180 according to an embodiment of the invention. The seventh dielectric layer 270 (see FIG. 5) is positioned between the seventh metal layer 170 and the eighth metal layer 180. The eighth metal layer 180 is similar or identical to the seventh metal layer 170. The eighth metal layer 180 only has an eighth slot region 185. The eighth slot region 185 of the eighth metal layer 180 is substantially aligned with the seventh slot region 175 of the seventh metal layer 170. In addition, the conductive via elements 440 are further coupled to the eighth metal layer 180. The conductive via elements 440 at least partially surround the eighth slot region 185 of the eighth metal layer 180.

In some embodiments, the transition device 500 further includes an auxiliary conductive via element 880 (FIGS. 12 and 13) which penetrate the third dielectric layer 230, the fourth dielectric layer 240, the fifth dielectric layer 250, the sixth dielectric layer 260, and the seventh dielectric layer 270. The auxiliary conductive via element 880 is configured to couple the third metal layer 130, the fourth metal layer 140, the fifth metal layer 150, the sixth metal layer 160, the seventh metal layer 170, and the eighth metal layer 180 with each other in series. In order to reduce the complexity of the manufacturing process, the auxiliary conductive via element 880 is neither coupled to the first metal layer 110 nor coupled to the second metal layer 120. The auxiliary conductive via element 880 has a vertical projection on the first metal layer 110, and the vertical projection is entirely inside the signaling metal line 410. According to practical measurements, the incorporation of the auxiliary conductive via element 880 can improve the grounding stability of the transition device 500 and further reduce the transmission loss of the transition device 500.

Figure 14:
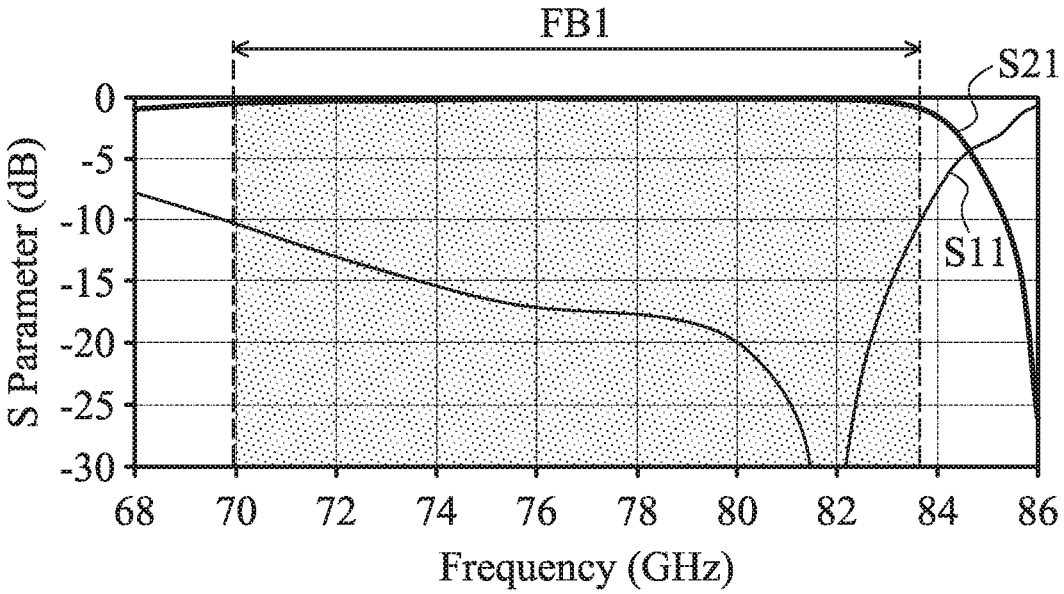
FIG. 14 is a diagram of S-parameters of a transition device according to an embodiment of the invention.

FIG. 14 is a diagram of S-parameters in dB vs. Frequency in GHz of the transition device 500 according to an embodiment of the invention. The signaling metal line 410 is used as a first port (Port 1) of the transition device 500. The waveguide 470 is used as a second port (Port 2) of the transition device 500. According to the measurement of FIG. 14, the transition device 500 including a multilayer circuit board can still cover an operational frequency band FB1 from 69.8 GHz to 83.7 GHz. Within the aforementioned operational frequency band FB1, the return loss of the transition device 500 (i.e., the absolute value of the S11-parameter) may be higher than 10 dB, and the insertion loss of the transition device 500 (i.e., the absolute value of the S21-parameter) may be lower than 1 dB. It can meet the requirements of practical application of general signal transition.

It should be noted that the transition device 500 including the multilayer circuit board can provide an additional circuit layout design region for accommodating a control circuit and relative metal traces. Therefore, the transition device 500 has the function of both energy transmission and signal control, and such a design helps to minimize the total device size.

In some embodiments, the element sizes and element parameters of the transition device 500 are described as follows. The total height HT (FIG. 6) of the first metal layer 110, the first dielectric layer 210, the second metal layer 120, the second dielectric layer 220, the third metal layer 130, the third dielectric layer 230, the fourth metal layer 140, the fourth dielectric layer 240, the fifth metal layer 150, the fifth dielectric layer 250, the sixth metal layer 160, the sixth dielectric layer 260, the seventh metal layer 170, the seventh dielectric layer 270, and the eighth metal layer 180 may be from 0.4 wavelength to 0.6 wavelength (0.4λ~0.6λ) of the operation frequency band FB1 of the transition device 500. It should be noted that the aforementioned total height HT should not be from 0.2 wavelength to 0.3 wavelength (0.2λ~0.3λ) of the operation frequency band FB1 of the transition device 500; otherwise, the transition device 500 may be changed from the band-pass function to the band-rejection function. Furthermore, the aforementioned dielectric layers may have identical or similar dielectric constants. For example, the dielectric constant ratio of any two dielectric layers may be from 0.8 to 1.2. The above ranges of element sizes and element parameters are calculated and obtained according to many experiment results, and they help to optimize the operation bandwidth and impedance matching of the transition device 500.

The invention proposes a novel transition device. In comparison to conventional designs, the invention has at least the advantages of small size, wide bandwidth, low loss, and high structural stability, and therefore it is suitable for application in a variety of communication devices.

Note that the above element sizes, element shapes, and frequency ranges are not limitations of the invention. A designer can fine-tune these settings or values to meet different requirements. It should be understood that the transition device of the invention is not limited to the configurations of FIGS. 1-14. The invention may merely include any one or more features of any one or more embodiments of FIGS. 1-14. In other words, not all of the features displayed in the figures should be implemented in the transition device of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A transition device, comprising:

a first metal layer, having a notch, wherein the notch extends to an interior of the first metal layer so as to form a first slot region;

a signaling metal line, disposed in the notch, and having a feeding point;

an excitation metal piece, disposed in the first slot region, and coupled to the signaling metal line;

a first dielectric layer, having a pair of first openings, wherein the first dielectric layer comprises a bridging portion disposed between the first openings, and the bridging portion is configured to carry the excitation metal piece;

a plurality of conductive via elements, penetrating the first dielectric layer, and coupled to the first metal layer, wherein the plurality of conductive via elements at least partially surround the first slot region;

a reflector, disposed adjacent to the excitation metal piece, wherein the first metal layer is positioned between the reflector and the first dielectric layer; and a waveguide, configured to receive radiation energy from the excitation metal piece and the reflector;

wherein a distance between two opposite sides of the first openings of the first dielectric layer is substantially from 0.8 times to 1.2 times a distance between two opposite sides of the first slot region of the first metal layer.

2. A transition device, comprising:

a first metal layer, having a notch, wherein the notch extends to an interior of the first metal layer so as to form a first slot region;

a signaling metal line, disposed in the notch, and having a feeding point;

an excitation metal piece, disposed in the first slot region, and coupled to the signaling metal line;

a first dielectric layer, having a pair of first openings, wherein the first dielectric layer comprises a bridging portion disposed between the first openings, and the bridging portion is configured to carry the excitation metal piece;

a plurality of conductive via elements, penetrating the first dielectric layer, and coupled to the first metal layer, wherein the plurality of conductive via elements at least partially surround the first slot region;

a reflector, disposed adjacent to the excitation metal piece, wherein the first metal layer is positioned between the reflector and the first dielectric layer; and a waveguide, configured to receive radiation energy from the excitation metal piece and the reflector;

wherein a width of each of the pair of first openings is from 0.23 times to 0.43 times a width of the first slot region.

3. A transition device, comprising:

a first metal layer, having a notch, wherein the notch extends to an interior of the first metal layer so as to form a first slot region;

a signaling metal line, disposed in the notch, and having a feeding point;

an excitation metal piece, disposed in the first slot region, and coupled to the signaling metal line;

a first dielectric layer, having a pair of first openings, wherein the first dielectric layer comprises a bridging portion disposed between the first openings, and the bridging portion is configured to carry the excitation metal piece;

a plurality of conductive via elements, penetrating the first dielectric layer, and coupled to the first metal layer, wherein the plurality of conductive via elements at least partially surround the first slot region;

a reflector, disposed adjacent to the excitation metal piece, wherein the first metal layer is positioned between the reflector and the first dielectric layer; and a waveguide, configured to receive radiation energy from the excitation metal piece and the reflector;

wherein a length of each of the first openings is from 0.8 times to 1 times a length of the first slot region.

4. The transition device as claimed in claim 3, wherein the pair of first openings of the first dielectric layer have a vertical projection on the first metal layer, and the vertical projection at least partially overlaps the first slot region of the first metal layer.

5. The transition device as claimed in claim 3, wherein the first metal layer comprises a first grounding portion and a second grounding portion which are adjacent to the notch, and a CPW (Coplanar Waveguide) is formed by the signaling metal line, the first grounding portion, and the second grounding portion.

6. The transition device as claimed in claim 3, wherein an operational frequency band of the transition device is form 69.8 GHz to 83.7 GHz.

7. The transition device as claimed in claim 6, wherein the reflector has a hollow portion and a sidewall opening which are connected to each other, the hollow portion is substantially aligned with the first slot region of the first metal layer, and the sidewall opening is substantially aligned with the notch of the first metal layer.

8. The transition device as claimed in claim 7, wherein a height of the hollow portion of the reflector is from 0.35 wavelength to 0.55 wavelength of the operational frequency band.

9. The transition device as claimed in claim 7, wherein a width of the sidewall opening of the reflector is shorter than 0.17 wavelength of the operational frequency band.

10. The transition device as claimed in claim 7, wherein a height of the sidewall opening of the reflector is from 0.1 wavelength to 0.18 wavelength of the operational frequency band.

11. The transition device as claimed in claim 3, further comprising:

a second metal layer, having a second slot region; and a second dielectric layer, having a pair of second openings, wherein the second metal layer is positioned between the first dielectric layer and the second dielectric layer;

wherein the plurality of conductive via elements further penetrate the second dielectric layer and are further coupled to the second metal layer.

12. The transition device as claimed in claim 11, further comprising:

a third metal layer, having a third slot region; and a third dielectric layer, having a pair of third openings, wherein the third metal layer is positioned between the second dielectric layer and the third dielectric layer;

wherein the plurality of conductive via elements further penetrate the third dielectric layer and are further coupled to the third metal layer.

13. The transition device as claimed in claim 12, further comprising:

a fourth metal layer, having a fourth slot region; and a fourth dielectric layer, having a pair of fourth openings, wherein the fourth metal layer is positioned between the third dielectric layer and the fourth dielectric layer;

wherein the plurality of conductive via elements further penetrate the fourth dielectric layer and are further coupled to the fourth metal layer.

14. The transition device as claimed in claim 13, further comprising:

a fifth metal layer, having a fifth slot region; and a fifth dielectric layer, having a pair of fifth openings, wherein the fifth metal layer is positioned between the fourth dielectric layer and the fifth dielectric layer;

wherein the plurality of conductive via elements further penetrate the fifth dielectric layer and are further coupled to the fifth metal layer.

15. The transition device as claimed in claim 14, further comprising:

a sixth metal layer, having a sixth slot region; and a sixth dielectric layer, having a pair of sixth openings, wherein the sixth metal layer is positioned between the fifth dielectric layer and the sixth dielectric layer;

wherein the plurality of conductive via elements further penetrate the sixth dielectric layer and are further coupled to the sixth metal layer.

16. The transition device as claimed in claim 15, further comprising:

a seventh metal layer, having a seventh slot region; and a seventh dielectric layer, having a pair of seventh openings, wherein the seventh metal layer is positioned between the sixth dielectric layer and the seventh dielectric layer;

wherein the plurality of conductive via elements further penetrate the seventh dielectric layer and are further coupled to the seventh metal layer.

17. The transition device as claimed in claim 16, further comprising:

an eighth metal layer, having an eighth slot region, wherein the plurality of conductive via elements are further coupled to the eighth metal layer.

18. The transition device as claimed in claim 17, further comprising:

an auxiliary conductive via element, penetrating the third dielectric layer, the fourth dielectric layer, the fifth dielectric layer, the sixth dielectric layer, and the seventh dielectric layer, wherein the auxiliary conductive via element is configured to couple the third metal layer, the fourth metal layer, the fifth metal layer, the sixth metal layer, the seventh metal layer, and the eighth metal layer in series with each other.

19. The transition device as claimed in claim 3, wherein the signaling metal line has a variable-width structure so as to form an impedance tuner.

* * * * *